US010201827B2

(12) United States Patent
Qu et al.

(10) Patent No.: US 10,201,827 B2
(45) Date of Patent: Feb. 12, 2019

(54) ADHESIVE DRIPPING DEVICE FOR ADHESIVE DISPENSING EQUIPMENT

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Litao Qu, Beijing (CN); Shih Lun Chen, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/674,189

(22) Filed: Aug. 10, 2017

(65) Prior Publication Data

US 2018/0200747 A1 Jul. 19, 2018

(30) Foreign Application Priority Data

Jan. 13, 2017 (CN) ..... 2017 2 0045157 U

(51) Int. Cl.

| | |
|---|---|
| ***B05C 5/02*** | (2006.01) |
| ***B05C 11/10*** | (2006.01) |
| *B05B 12/08* | (2006.01) |
| *B05B 12/02* | (2006.01) |

(52) U.S. Cl.

CPC ..... *B05C 5/0225* (2013.01); *B05C 11/10* (2013.01); *B05B 12/02* (2013.01); *B05B 12/087* (2013.01)

(58) Field of Classification Search

CPC combination set(s) only.
See application file for complete search history.

(56) References Cited

U.S. PATENT DOCUMENTS 4,579,255 A * 4/1986 Frates ..... B05C 5/0225 222/149
4,922,852 A * 5/1990 Price ..... B05C 5/0225 118/323
6,029,903 A * 2/2000 Fukano ..... B05C 11/1026 222/571

(Continued)

*Primary Examiner* — Binu Thomas
(74) *Attorney, Agent, or Firm* — Kinney & Lange, P.A.

(57) ABSTRACT

An adhesive dripping device for adhesive dispensing equipment includes: a housing defining a mounting chamber therein, a lower end of the housing being provided with a nozzle communicating with the mounting chamber; a core stem mounted in an upper portion of the mounting chamber; an electromagnetic coil wound around the core stem; an elastic member fitting over the core stem; an adhesive dripping assembly mounted in the mounting chamber below the elastic member and configured for dripping adhesive through the nozzle; a pressure sensor mounted on a top end of the mounting chamber and abutting against an upper end of the elastic member; and a control unit electrically connected to the pressure sensor and the electromagnetic coil and configured for adjusting a current in the electromagnetic coil according to a pressure detected by the pressure sensor, so as to control an adhesive dripping amount of the adhesive dripping assembly.

16 Claims, 3 Drawing Sheets

(56) References Cited

U.S. PATENT DOCUMENTS

| | | | | |
|---|---|---|---|---|
| 6,092,782 | A * | 7/2000 | Yamada | F16K 23/00 222/571 |
| 6,354,471 | B2 * | 3/2002 | Fujii | B05C 5/0225 222/325 |
| 6,849,130 | B2 * | 2/2005 | Estelle | B05C 11/1021 118/682 |
| 6,983,860 | B2 * | 1/2006 | Arnaboldi | B05C 5/0225 222/146.2 |
| 2007/0051718 | A1 * | 3/2007 | Schmitt | B29C 65/46 219/635 |
| 2012/0205568 | A1 * | 8/2012 | Bush | E03D 5/02 251/129.15 |
| 2012/0273071 | A1 * | 11/2012 | Kai | B05C 5/0225 137/565.17 |
| 2014/0346253 | A1 * | 11/2014 | Ikushima | B05C 5/0225 239/337 |
| 2017/0113241 | A1 * | 4/2017 | Qu | B05C 5/0225 |

* cited by examiner

ADHESIVE DRIPPING DEVICE FOR ADHESIVE DISPENSING EQUIPMENT

CROSS-REFERENCE TO RELATED APPLICATION

This application claims the benefit of Chinese Patent Application No. 201720045157.5 filed on Jan. 13, 2017 in the State Intellectual Property Office of China, the disclosure of which is incorporated in entirety herein by reference.

BACKGROUND

Technical Field

Embodiments of the present disclosure relate to a field of display device manufacture, and more particularly, to an adhesive dripping device for an adhesive dispensing equipment.

Description of the Related Art

An adhesive dripping device for adhesive dispensing equipment is mainly used in a sealant coating (sealing frame coating) and filler dot forming process (collectively called: coating dot-forming process), and the adhesive dripping device for adhesive dispensing equipment is used for forming a dot on a glass by filling adhesive (filler material, filling material). As for the current adhesive dripping device for adhesive dispensing equipment, it is necessary to manually adjust an adjustment rod to change adhesive dripping amount in a process of adhesive dripping, thereby the operation is not convenient and is relatively time-consuming, and position adjustment of the adjustment rod largely depends on proficiency and experience of an operator, thereby it is difficult to ensure a precise adhesive dripping amount.

SUMMARY

In order to address at least one of the above technical problems, embodiments of the present disclosure provide an adhesive dripping device for adhesive dispensing equipment.

In order to achieve the object of the present disclosure, an embodiment of the present disclosure provides an adhesive dripping device for adhesive dispensing equipment, comprising:

a housing defining a mounting chamber therein, a lower end of the housing being provided with a nozzle communicating with the mounting chamber;

a core stem mounted in an upper portion of the mounting chamber;

an electromagnetic coil wound around the core stem;

an elastic member fitting over the core stem;

an adhesive dripping assembly mounted in the mounting chamber below the elastic member and configured for dripping adhesive through the nozzle;

a pressure sensor mounted on a top end of the mounting chamber and abutting against an upper end of the elastic member; and a control unit electrically connected to the pressure sensor and the electromagnetic coil and configured for adjusting a current in the electromagnetic coil according to a pressure detected by the pressure sensor, so as to control an adhesive dripping amount of the adhesive dripping assembly.

Optionally, the adhesive dripping device further comprises a current sensor electrically connected to the electromagnetic coil and the control unit and configured for detecting the current in the electromagnetic coil and feeding it back to the control unit, so as to allow the control unit to monitor the current in the electromagnetic coil in real time.

Optionally, the adhesive dripping device further comprises a flexible stopper fixed to a lower end of the elastic member and configured for blocking a driving rod of the adhesive dripping assembly from moving upward to impact on the core stem during an adhesive dripping process.

Optionally, the flexible stopper is annular, and an inner diameter of the flexible stopper is less than diameters of the core stem and the driving rod.

Optionally, the flexible stopper is made from silica gel, rubber or plastic.

Optionally, the core stem is an electromagnetic core, and the driving rod is made from iron.

Optionally, the elastic member is a coil spring, and a lower end of the coil spring is lower than a lower end of the core stem.

Optionally, the adhesive dripping device further comprises a fixing head mounted on an outer side of a top wall of the housing, wherein an upper end of the core stem passes through the top wall of the housing and is connected to the fixing head.

Optionally, the core stem is integrally formed with the fixing head.

Optionally, the housing comprises an upper casing and a lower casing, and the control unit is fixed in the upper casing.

Other features and advantages of the present disclosure will be set forth in the following specification, and a portion of them will be obvious from the specification, or they may be learned by implementing the present disclosure. The objects and other advantages of the present disclosure may be realized and obtained by the structures particularly pointed out in the specification, the claims and the drawings.

BRIEF DESCRIPTION OF THE DRAWINGS

The accompanying drawings are intended to provide a further understanding of the present disclosure and form a portion of the specification. The accompanying drawings serve to explain the technical solutions of the present disclosure, together with the embodiments of the present disclosure, but are not intended to limit the scope of the present disclosure.

DETAILED DESCRIPTION OF PREFERRED EMBODIMENTS

In order to make clear the objects, the technical solutions and the advantages of the present disclosure, embodiments of the present disclosure will be described in detail hereinafter with reference to the accompanying drawings. It should be noted that the embodiments and the features of the embodiments in the present disclosure may be freely combined with each other without conflicting.

A number of specific details are set forth in the following description so as to fully understand the present disclosure, but the present disclosure may be implemented in a manner other than that is described herein. Thus, the scope of the present disclosure is not limited to the specific embodiments disclosed below.

Figure 1:
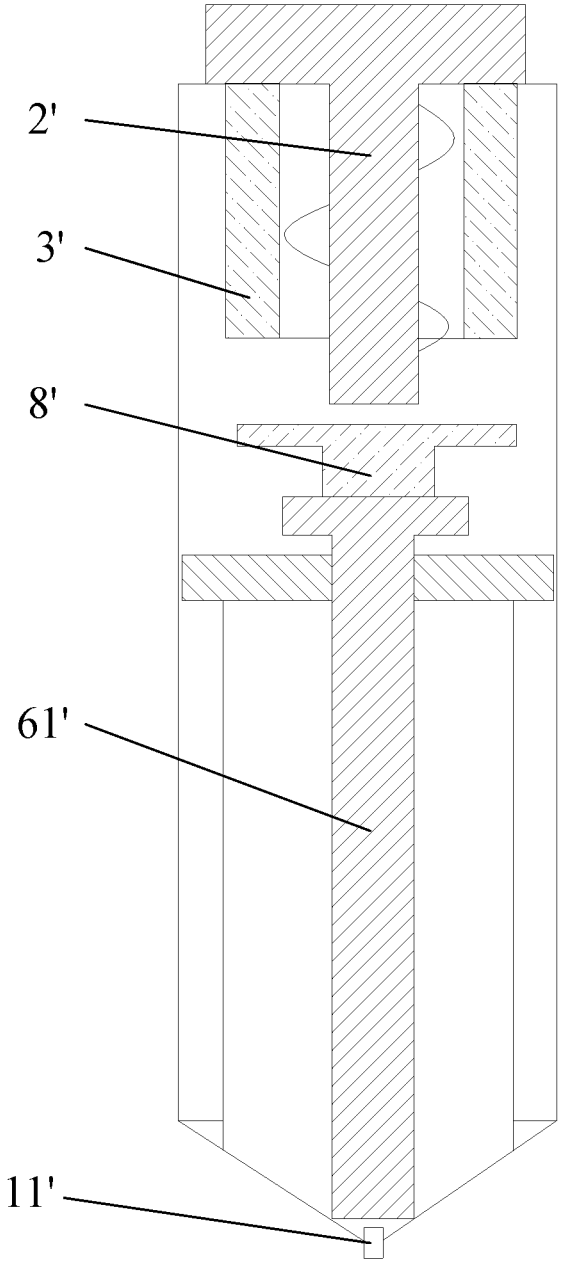
Prior Art Fig. 1
FIG. 1 is a schematic cross sectional view showing a structure of an adhesive dripping device for adhesive dispensing equipment.

FIG. 1 shows an adhesive dripping device for adhesive dispensing equipment. In the adhesive dripping device, a top end of a driving rod 61' for controlling an adhesive material outlet is magnetically attracted together with a lower end of the transition piece 8'. When an electromagnet 3' at periphery thereof is energized, the generated electromagnetic force attracts an upper portion of the transition piece to realize opening of the adhesive outlet (i.e., a nozzle 11') at an end of the driving rod 61', thereby completing the dripping of the adhesive material. A maximum lifting height of the driving rod 61' may be controlled by adjusting an adjustment head to control a height of an adjustment rod 2' (an adjustment of an opening degree between the driving rod 61' and the adhesive outlet may be achieved), thereby a dripping amount of the adhesive material may be controlled. It is necessary to manually adjust the adjustment head to change adhesive dripping amount in a process of adhesive dripping, thereby the operation is not convenient and is relatively time-consuming, and position adjustment of the adjustment rod largely depends on proficiency and experience of an operator, thereby it is difficult to ensure precise adhesive dripping amount.

The embodiments of the present disclosure provide an adhesive dripping device for adhesive dispensing equipment, in place of the conventional manual adjustment and control. By means of high precision control capability of a control unit, it achieves a purpose of controlling precise dripping of the adhesive material.

An adhesive dripping device for adhesive dispensing equipment according to some embodiments of the present disclosure will now be described with reference to the accompanying drawings.

Figure 2:
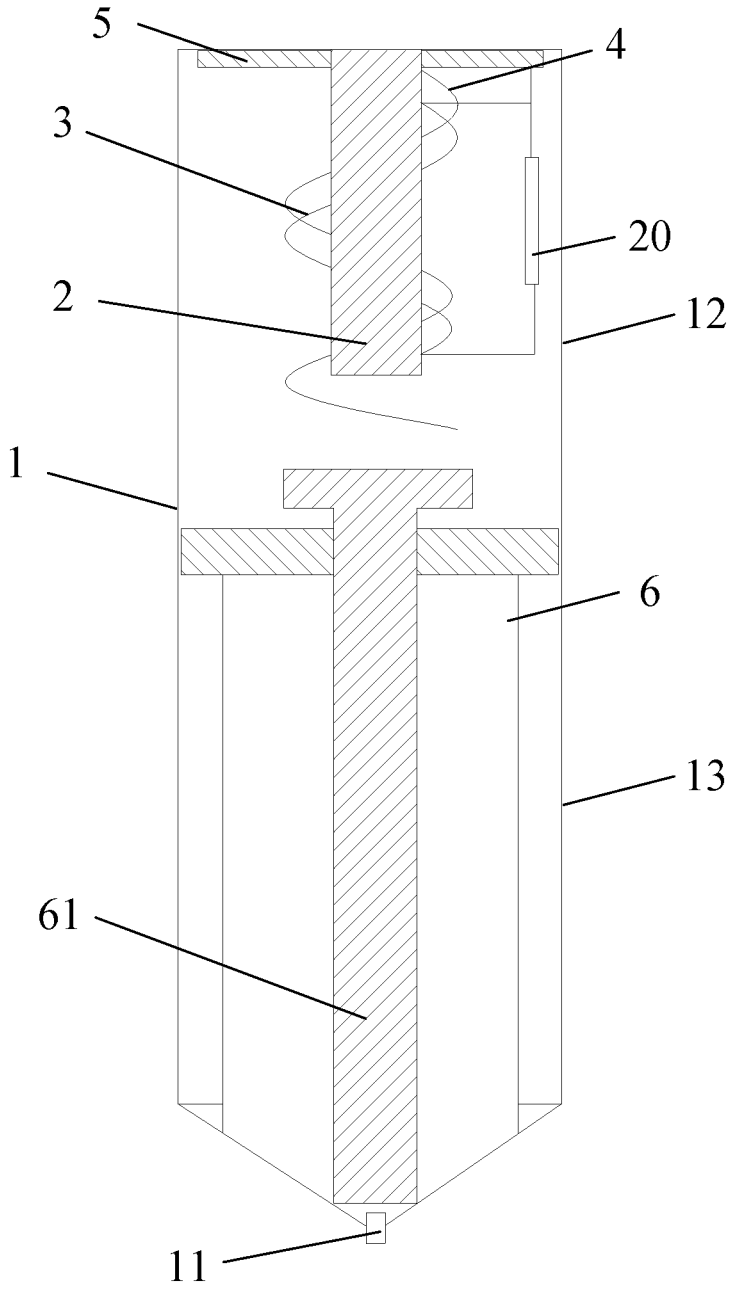
FIG. 2 is a schematic cross sectional view showing a structure of an adhesive dripping device for adhesive dispensing equipment according to an embodiment of the present disclosure.

As shown in FIG. 2, the adhesive dripping device for adhesive dispensing equipment according to an embodiment of the present disclosure includes: a housing 1 defining a mounting chamber therein, a lower end of the housing being provided with a nozzle 11 communicating with the mounting chamber; a core stem 2 mounted in an upper portion of the mounting chamber; an electromagnetic coil 3 wound around the core stem 2; an elastic member 4 fitting over the core stem 2; an adhesive dripping assembly 6 mounted in the mounting chamber below the elastic member 4 and configured for dripping adhesive through the nozzle; a pressure sensor 5 mounted on a top end of the mounting chamber and abutting against an upper end of the elastic member 4; and a control unit 20 electrically connected to the pressure sensor 5 and the electromagnetic coil 3 and configured for adjusting a current in the electromagnetic coil 3 according to a pressure detected by the pressure sensor 5, so as to control an adhesive dripping amount of the adhesive dripping assembly 6.

In the adhesive dripping device for adhesive dispensing equipment according to the embodiments of the present disclosure, the control unit 20 controls the current in the electromagnetic coil 3 according to the pressure detected by the pressure sensor 5, to adjust attraction force of the core stem 2 to a driving rod 61 of the adhesive dripping assembly 6 and control a lifting height of the driving rod 61, thereby an opening degree between the driving rod 61 and the nozzle 11 may be adjusted so as to achieve a purpose of precise adhesive dripping.

Figure 3:
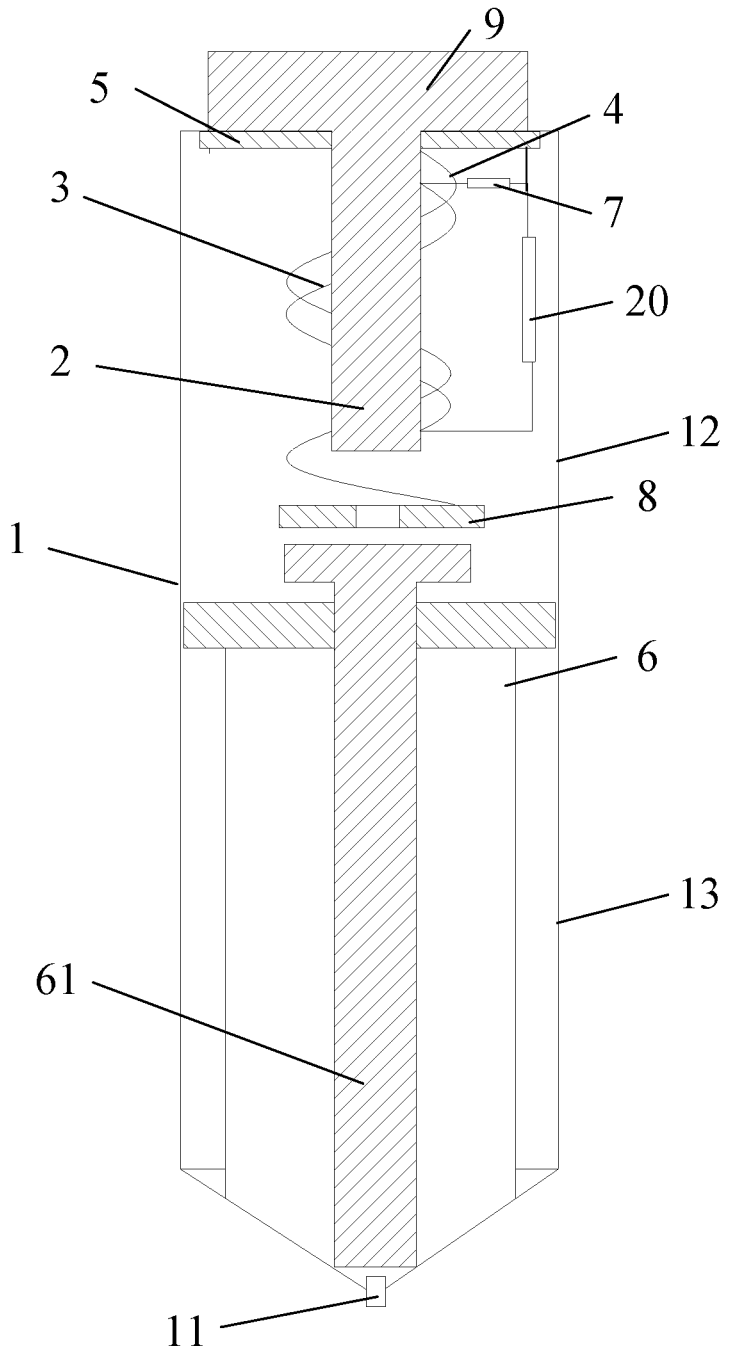
FIG. 3 is a schematic cross sectional view showing a structure of an adhesive dripping device for adhesive dispensing equipment according to another embodiment of the present disclosure.

As shown in FIG. 3, the adhesive dripping device for adhesive dispensing equipment according to another embodiment of the present disclosure includes: a housing 1 defining a mounting chamber therein, a lower end of the housing being provided with a nozzle 11 communicating with the mounting chamber; a core stem 2 mounted in an upper portion of the mounting chamber; an electromagnetic coil 3 wound around the core stem 2; an elastic member 4 fitting over the core stem 2; an adhesive dripping assembly 6 mounted in the mounting chamber below the elastic member 4 and configured for dripping adhesive through the nozzle; a pressure sensor 5 mounted on a top end of the mounting chamber and abutting against an upper end of the elastic member 4; a control unit 20 electrically connected to the pressure sensor 5 and the electromagnetic coil 3; and a current sensor 7 electrically connected to the electromagnetic coil 3 and the control unit and configured for detecting a current in the electromagnetic coil 3 and feeding it back to the control unit. The control unit adjusts the current in the electromagnetic coil 3 according to the pressure detected by the pressure sensor 5 and monitors the current in the electromagnetic coil 3 in real time according to the current fed back by the current sensor 7, so as to realize a closed loop control. In this way, the current in the electromagnetic coil 3 may be timely adjusted when it sharply increases or decreases, so as to further ensure precise adhesive dripping.

In the adhesive dripping device for adhesive dispensing equipment according to the embodiments of the present disclosure, the control unit 20 controls the current in the electromagnetic coil 3 according to the pressure detected by the pressure sensor 5 and monitors the current in the electromagnetic coil 3 in real time according to the current fed back by the current sensor 7, so as to realize a closed loop control. In this way, the current in the electromagnetic coil 3 may be timely adjusted when it sharply increases or decreases, to prevent the current in the electromagnetic coil 3 from sharply increasing or decreasing, to precisely adjust the attraction force of the core stem 2 to the driving rod 61 of the adhesive dripping assembly 6 and control the lifting height of the driving rod 61. As a result, the opening degree between the driving rod 61 and the nozzle 11 may be adjusted, while the driving rod 61 is prevented from suddenly lifting up or lowering down due to the sharp increase or decrease of the current in the electromagnetic coil 3, and further a sudden change of the opening degree between the driving rod 61 and the nozzle 11 is avoided, thereby achieving the purpose of precise adhesive dripping.

If the electromagnetic coil 3 is energized, an upward attraction force is applied to the driving rod 61 under the action of the electromagnetic coil 3 and the core stem 2, then the driving rod 61 is pulled up and the nozzle 11 is opened, thereby completing the dripping of the adhesive material. The pressure sensor 5 is used to monitor a pressure value of the elastic member 4 during the adhesive dripping process, which is fed back to the control unit to adjust the magnitude of the current in the electromagnetic coil 3. If the pressure value is less than a preset pressure, then the current in the electromagnetic coil 3 is increased, or if the pressure value is greater than the preset pressure, then the current in the electromagnetic coil 3 is decreased. At the same time, the current sensor 7 detects the current in the electromagnetic coil 3 and feeds it back to the control unit, and the control unit performs a closed loop control to the current in the electromagnetic coil 3, to prevent the current in the electromagnetic coil 3 from sharply increasing or decreasing, thereby the lifting height of the driving rod may be better controlled during the adhesive dripping process, and ultimately an intended adhesive dripping amount of the adhesive material may be precisely controlled.

Optionally, the adhesive dripping device for adhesive dispensing equipment further includes a flexible stopper 8 fixed to a lower end of the elastic member 4. The adhesive dripping assembly 6 is mounted in a sub-space at the lower end of the housing 1, the flexible stopper 8 is located between the driving rod 61 and the core stem 2 in an direction from top to bottom, and the flexible stopper 8 is configured for blocking the driving rod 61 of the adhesive dripping assembly 6 from moving upward to impact on the core stem 2 during the adhesive dripping process, thereby preventing a rigid contact between the driving rod 61 and the core stem 2.

Optionally, the flexible stopper 8 is annular, and an inner diameter of the flexible stopper 8 is less than diameters of the core stem 2 and the driving rod 61.

Exemplarily, the flexible stopper 8 is made from silica gel, rubber, plastic or the like. The core stem 2 is an electromagnetic core, and the driving rod 61 is made from iron.

The flexible stopper 8 is fixed to the lower end of the elastic member 4 and the inner diameter of the flexible stopper 8 is less than the diameters of the core stem 2 and the driving rod 61. After the adhesive dripping assembly 6 is mounted in the sub-space, the driving rod 61 cannot mechanically collide with the core stem 2 even it moves upward to the maximum position in operation mode, and the flexible stopper 8 functions as a cushioning effect and effectively protects the core stem 2 and the driving rod 61.

Optionally, the elastic member 4 is a coil spring, and a lower end of the coil spring is lower than a lower end of the core stem 2. The length, by which the coil spring is lower than the core stem 2 forms a stroke of the driving rod 61. The maximum lifting height of the driving rod 61 and further the maximum adhesive dispensing amount of the adhesive dripping assembly 6 depend on the position of the lower end of the core stem 2.

It is possible to improve the driving rod, for example, a blind hole is provided in the top of the driving rod, and the lower end of the core stem 2 extends into the blind hole, so as to increase travelling distance of the driving rod 61 moving upward. In this way, the object of the present disclosure may also be achieved, and the spirit does not depart from the design concept of the present disclosure, therefore such technical solution which will not be described in detail also falls within the scope of the present disclosure.

The coil spring may be provided on an outer side of the electromagnetic coil, or the coil spring may be provided on an inner side of the electromagnetic coil, or the coil spring may be wound together with the electromagnetic coil. The object of the present disclosure may be achieved by those technical solutions, and the spirit does not depart from the design concept of the present disclosure, therefore such technical solutions which will not be described in detail also fall within the scope of the present disclosure.

Optionally, the coil spring has an appropriate elasticity capacity and has a highly precise elastic stiffness coefficient. In order to avoid the affection on precision of the adhesive dripping device due to the change of the elasticity capacity of the coil spring, the elastic stiffness coefficient of the coil spring may be confirmed periodically. By increasing the current in the electromagnetic coil under standard conditions such that the maximum pressure is applied to the spring, the elastic stiffness coefficient of the coil spring may be confirmed according to the maximum pressure applied to the spring. If the elastic stiffness coefficient of the coil spring changes beyond the needs of the adhesive dripping device, it is necessary to replace the spring timely so as to ensure a highly precise control of the adhesive dripping device.

In an example, the pressure sensor 5 (the pressure sensor 5 in FIG. 3 is of an annular structure fitting over the core stem 2) is fixed to an inner top wall of the housing 1.

Optionally, the adhesive dripping device further comprises a fixing head 9 located outside of the housing 1 and fixedly mounted on a top wall of the housing 1, and an upper end of the core stem 2 passes through the top wall of the housing 1 and is connected to the fixing head 9.

Optionally, the core stem 2 is integrally formed with the fixing head 9. In this way, the position of the core stem 2 may be determined only by fixing the fixing head 9 to the housing 1, thereby facilitating mounting of the core stem 2 and having more practicability.

Optionally, the housing 1 comprises an upper casing 12 and a lower casing 13, and the control unit 20 is mounted in the upper casing 12. The upper casing 12 and the lower casing 13 are firstly disassembled, then the adhesive dripping assembly 6 is mounted in the lower casing 13, then the upper casing 12 and the lower casing 13 are assembled together, thus, the combination may be used normally.

In view of the above, in the adhesive dripping device for adhesive dispensing equipment according to the embodiments of the present disclosure, the control unit controls the current in the electromagnetic coil according to the pressure detected by the pressure sensor, to adjust the attraction force of the core stem to the driving rod of the adhesive dripping assembly and thereby control the lifting height of the driving rod, therefore the opening degree between the driving rod and the nozzle may be adjusted so as to achieve a purpose of precise adhesive dripping.

Further, the flexible stopper is fixed to the lower end of the elastic member and the inner diameter of the flexible stopper is less than the diameters of the core stem and the driving rod. After the adhesive dripping assembly is mounted in the sub-space, the driving rod cannot mechanically collide with the core stem even it moves upward to the maximum position in operation mode, and the flexible stopper functions as a cushioning effect and effectively protects the core stem and the driving rod.

In the description of the present disclosure, the terms "mount", "join", "connect", "fix" and the like should be broadly understood, for example, "connect" may refer to a fixed connection, a detachable connection, or an integral connection; may refer to a direct connection or an indirect connection via an intermediate medium. The specific meaning of the above terms in the present disclosure may be understood by those skilled in the art in light of specific circumstances.

In the description of this specification, the terms "an embodiment", "some embodiments", "specific embodiments" and the like mean that the specific features, structures, materials or characteristics described in connection with the embodiment(s) or example(s) are included in at least one embodiment or example in the present disclosure. In this specification, the schematic recitation of the above terms does not necessarily refer to the same embodiment or example. Moreover, the described specific features, structures, materials or characteristics may be combined in any one or more embodiments or examples in any suitable manner.

While the above embodiments in the present disclosure have been described, the description is only intended to facilitate understanding the implementation of the present disclosure, but not intended to limit the present disclosure. Any modifications and variations may be made to the present disclosure by those skilled in the art in aspects of form and detail, without departing from the spirit and scope of the present disclosure, and the scope of the present disclosure is defined in the appended claims.

What is claimed is:

1. An adhesive dripping device for adhesive dispensing equipment, comprising:

a housing defining a mounting chamber therein, a lower end of the housing being provided with a nozzle communicating with the mounting chamber;

a core stem mounted in an upper portion of the mounting chamber;

an electromagnetic coil wound around the core stem;

an elastic member fitting over the core stem;

an adhesive dripping assembly mounted in the mounting chamber below the elastic member and configured for dripping adhesive through the nozzle;

a pressure sensor mounted on a top end of the mounting chamber and abutting against an upper end of the elastic member, and a control unit electrically connected to the pressure sensor and the electromagnetic coil and configured for adjusting a current in the electromagnetic coil according to a pressure detected by the pressure sensor, so as to control an adhesive dripping amount of the adhesive dripping assembly, wherein the elastic member is a coil spring, and a lower end of the coil spring is lower than a lower end of the core stem.

2. The adhesive dripping device according to claim 1, further comprising:

a current sensor electrically connected to the electromagnetic coil and the control unit and configured for detecting the current in the electromagnetic coil and providing feedback to the control unit, so as to allow the control unit to monitor the current in the electromagnetic coil in real time.

3. The adhesive dripping device according to claim 1, further comprising:

a flexible stopper fixed to the lower end of the coil spring and configured for blocking a driving rod of the adhesive dripping assembly from moving upward to impact on the core stem during an adhesive dripping process.

4. The adhesive dripping device according to claim 3, wherein the flexible stopper is annular, and an inner diameter of the flexible stopper is less than diameters of the core stem and the driving rod.

5. The adhesive dripping device according to claim 3, wherein the flexible stopper is made from silica gel, rubber or plastic.

6. The adhesive dripping device according to claim 3, wherein the core stem is an electromagnetic core, and the driving rod is made from iron.

7. The adhesive dripping device according to claim 1, further comprising a fixing head mounted on an outer side of a top wall of the housing, wherein an upper end of the core stem passes through the top wall of the housing and is connected to the fixing head.

8. The adhesive dripping device according to claim 7, wherein the core stem is integrally formed with the fixing head.

9. The adhesive dripping device according to claim 1, wherein the housing comprises an upper casing and a lower casing, and the control unit is fixed in the upper casing.

10. The adhesive dripping device according to claim 4, wherein the flexible stopper is made from silica gel, rubber or plastic.

11. The adhesive dripping device according to claim 4, wherein the core stem is an electromagnetic core, and the driving rod is made from iron.

12. The adhesive dripping device according to claim 2, further comprising a fixing head mounted on an outer side of a top wall of the housing, wherein an upper end of the core stem passes through the top wall of the housing and is connected to the fixing head.

13. The adhesive dripping device according to claim 3, further comprising a fixing head mounted on an outer side of a top wall of the housing, wherein an upper end of the core stem passes through the top wall of the housing and is connected to the fixing head.

14. The adhesive dripping device according to claim 4, further comprising a fixing head mounted on an outer side of a top wall of the housing, wherein an upper end of the core stem passes through the top wall of the housing and is connected to the fixing head.

15. The adhesive dripping device according to claim 2, wherein the housing comprises an upper casing and a lower casing, and the control unit is fixed in the upper casing.

16. The adhesive dripping device according to claim 3, wherein the housing comprises an upper casing and a lower casing, and the control unit is fixed in the upper casing.

* * * * *